US005192076A

United States Patent [19]

Komori

[11] Patent Number: 5,192,076

[45] Date of Patent: Mar. 9, 1993

[54] KENO GAME PLAYING APPARATUS

[75] Inventor: Takashi Komori, Tokyo, Japan

[73] Assignee: Sigma, Inc., Tokyo, Japan

[21] Appl. No.: 793,293

[22] Filed: Nov. 14, 1991

Related U.S. Application Data

[63] Continuation of Ser. No. 443,492, Nov. 30, 1989, abandoned.

[51] Int. Cl.[5] ..... A63B 71/06

[52] U.S. Cl. ..... 273/138 A; 273/454; 364/411

[58] Field of Search ..... 273/138 R, 138 A, 237, 273/433, 434, 437, 438, 454, 460; 364/410, 411, 412

[56] References Cited

U.S. PATENT DOCUMENTS

| | | | |
|---|---|---|---|
| 3,533,629 | 10/1970 | Raven | 273/138 A |
| 3,770,269 | 11/1973 | Elder . | |
| 4,095,785 | 6/1978 | Conner . | |
| 4,455,025 | 6/1984 | Itkis | 273/237 |
| 4,624,462 | 11/1986 | Itkis | 273/237 |
| 4,648,600 | 3/1987 | Olliges | 273/138 A |
| 4,836,546 | 6/1989 | DiRe et al. | 273/138 A |
| 4,856,787 | 8/1989 | Itkis | 273/269 |

*Primary Examiner*—V. Millin
*Assistant Examiner*—Sebastiano Passaniti

[57] ABSTRACT

A keno-game playing apparatus of this invention includes display units for displaying a state of progress of a game. The number of numerals selected so far by the keno-game playing apparatus and the corresponding number of hits are visually displayed on these display units.

2 Claims, 6 Drawing Sheets

Fig.3
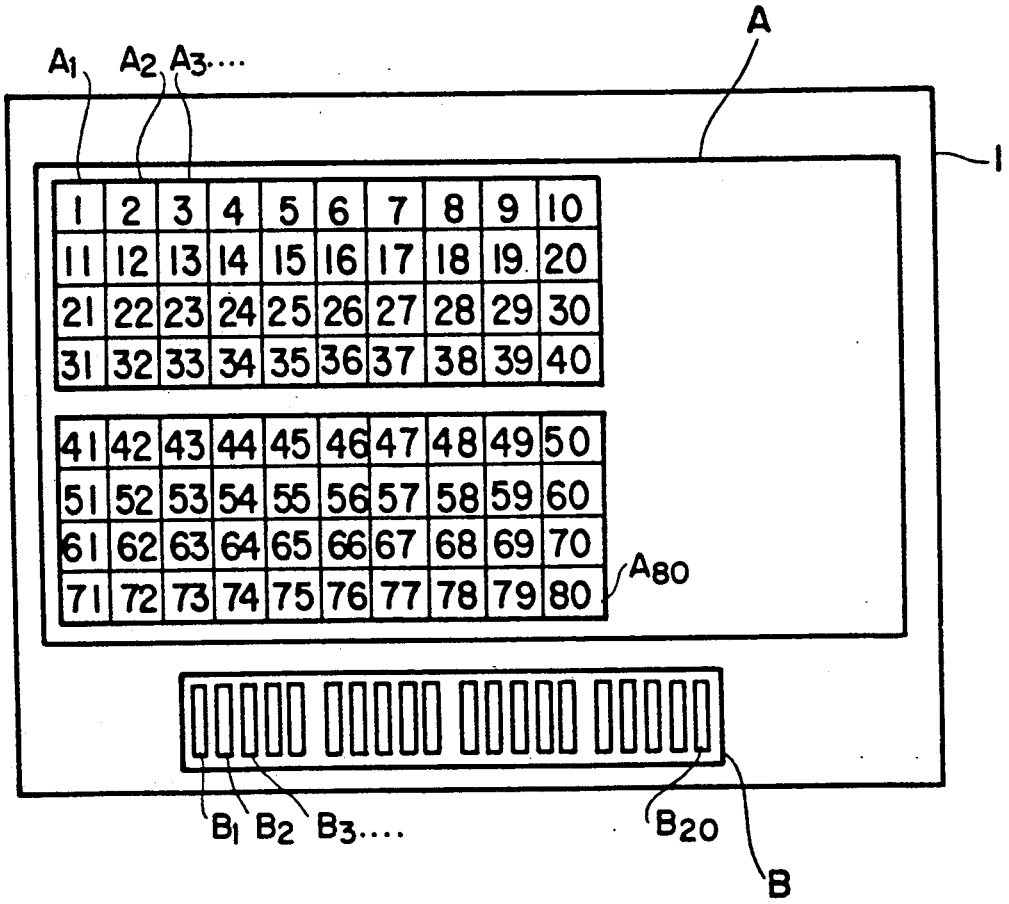
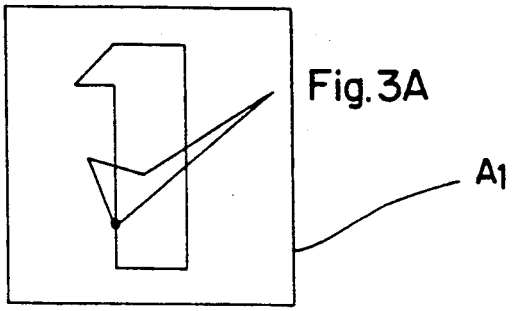
Fig.3A

KENO GAME PLAYING APPARATUS

This is a continuation application under 37 C.F.R. 1.62 of prior application Ser. No. 07/443,492, filed on Nov. 30, 1989, now abandoned.

BACKGROUND OF THE INVENTION

1. Field of the Invention

The present invention relates to a Keno-game playing apparatus and, more particularly, to a keno-game playing apparatus capable of allowing a player to easily and visually know the progress of the game and the number of hits during the game.

2. Description of the Prior Art

Keno is a game similar to bingo where the player attempts to match as many numbers as possible with numbers generated by the apparatus. Each time the player's selection coincides with a machine produced number it is referred to as "a hit." The more hits a player achieves, the greater the winnings.

A conventional keno-game playing apparatus includes display elements with numerals of 1 to 80. A player first inserts a coin as a bet and selects two to ten display elements with desired numerals from the 80 display elements arranged in the keno-game playing apparatus. The player then depresses the selected display elements with a light pen arranged in a display board on a control panel designating the numberals to be selected. Check marks or the like are displayed on the selected and designated display elements. The player depresses a start button. The display elements of the keno-game playing apparatus flash randomly to display 20 numerals of the display elements such that each numeral is colored in yellow on a blue background. When some numerals selected by the player coincide with numerals designated by the random numbers, the color of the display element with a hit numeral is changed from blue to red. When the keno-game playing apparatus designates all 20 numerals and the corresponding display elements are colored as described above, the game is ended. When the number of numerals selected by the player and coinciding with the numerals selected by the playing apparatus exceed a predetermined number, e.g., the number or hit numerals is 3 of more, coins are paid off in accordance with the number of hit numerals and the number of coins inserted in the playing apparatus.

In a conventional keno-game playing apparatus, the progress of the game, e.g., the total number of numerals selected by the player and coinciding with the numerals selected by the apparatus, i.e., the number of hits or the like can be known only by observing the display elements with the numerals of 1 to 80. The player must count the hit numerals on the display board. Therefore, it is difficult to determine the number of hits at a glance.

SUMMARY OF THE INVENTION

It is an object of the present invention to provide a keno-game playing apparatus, including display units, for allowing a player to easily and visually know the progress of the game and the number of hits.

It is another object of the present invention to provide a keno-game playing apparatus comprising a first display unit for displaying a predetermined number of identifiers, a designation apparatus for designating a plurality of desired identifiers from those displayed on the first display unit in accordance with an external instruction, a selection display unit for sequentially and randomly designating and displaying a plurality of identifiers from those displayed on the first display unit, and a second display unit for sequentially displaying a state of coincidence between the identifiers designated by the designation apparatus and the identifiers designated by a selection unit with the number of hits in association with a display of the selection display unit.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 3 is a plan view showing the display units of the keno-game playing apparatus;

DESCRIPTION OF THE PREFERRED EMBODIMENT

Figure 1:
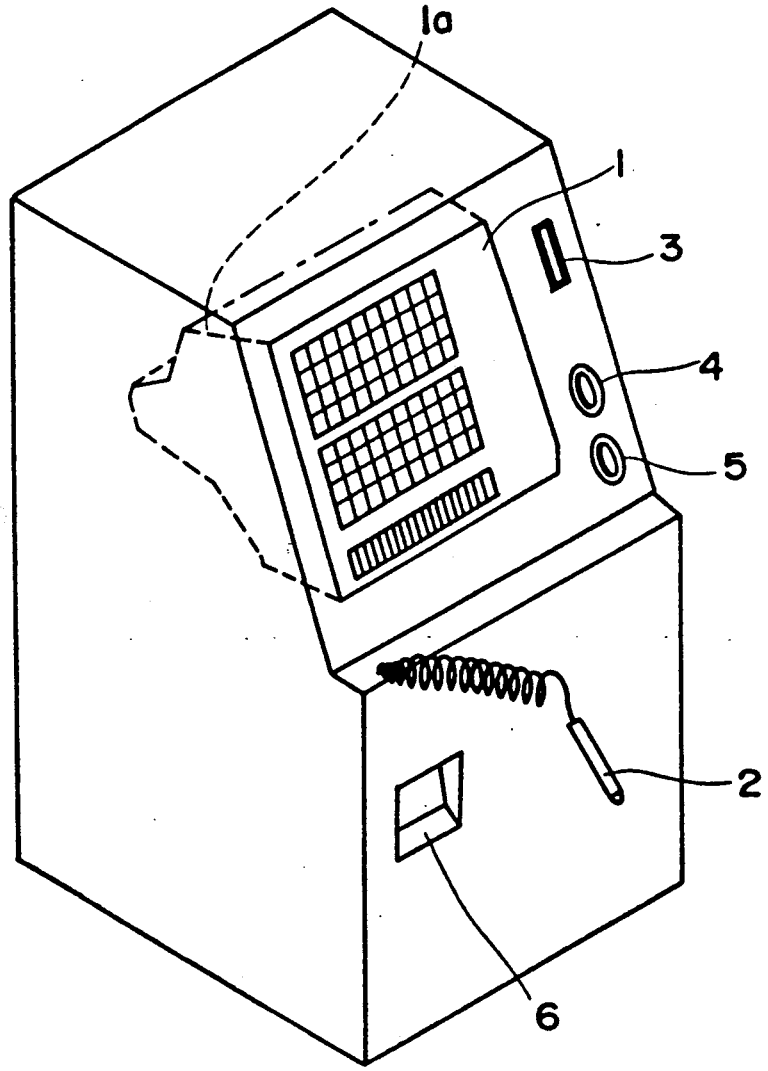
FIG. 1 is a perspective view showing an outer appearance of a keno-game playing apparatus according to the present invention.
Figure 2:
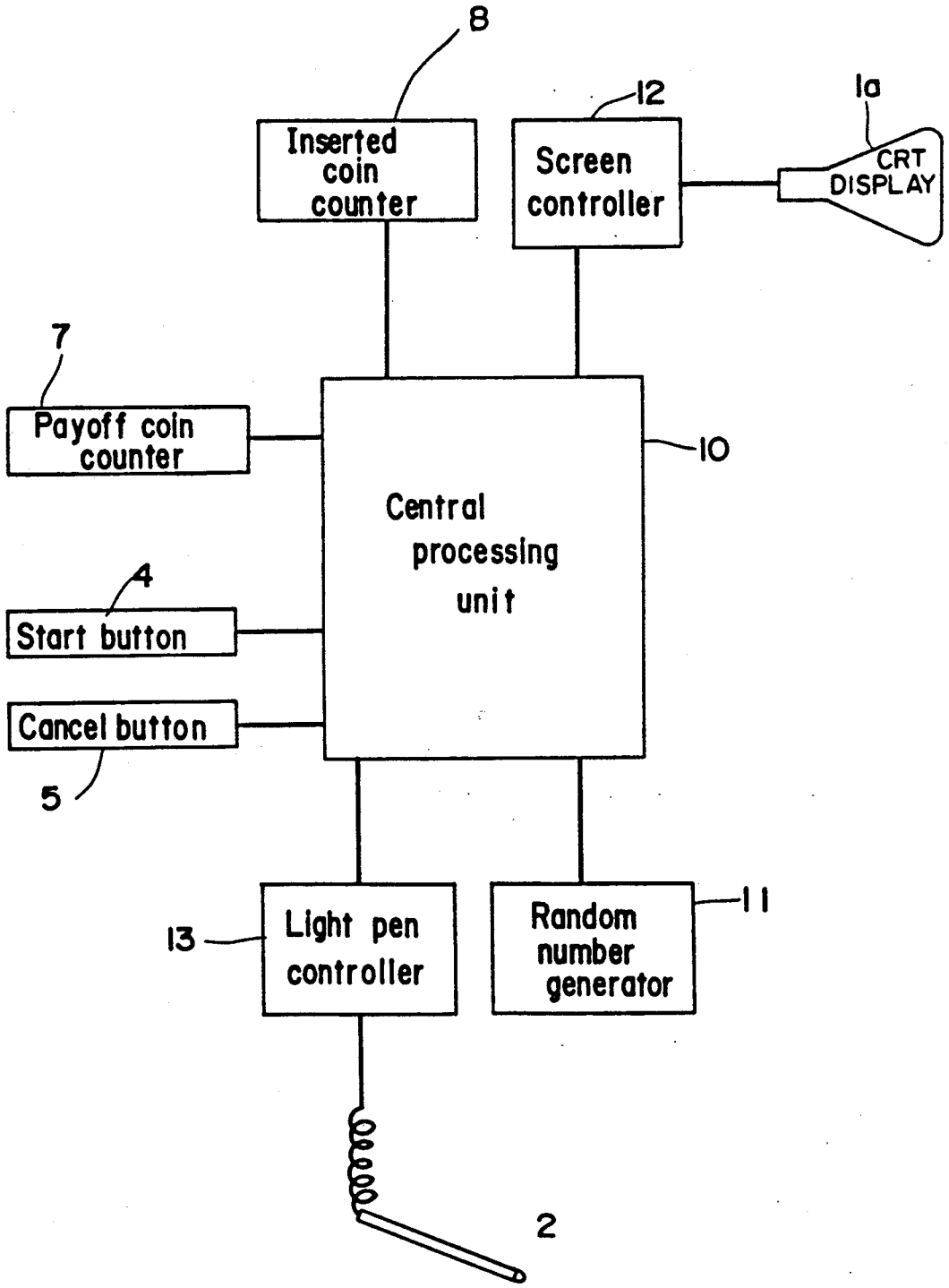
FIG. 2 is a block diagram showing a schematic arrangement of the keno-game playing apparatus according to the present invention.

FIG. 1 shows a diagram of the outer appearance of a keno-game playing apparatus according to a preferred embodiment of the present invention. As shown in FIG. 1, the keno-game playing apparatus includes a CRT display 1 for displaying the progress of the game and a light pen 2 with which a player can designate desired numbers on the CRT screen 1. In addition, the keno-game playing apparatus includes a coin slot 3 for inserting coins, a start button 4 for starting a keno-game, and a cancel button 5 for canceling numerals designated on the CRT display 1. A coin counter 5 is arranged at the coin slot 3 to count the number of coins inserted in the coin slot 3. The keno-game playing apparatus further includes an inserted coin counter 8 for counting the number of coins inserted in the coin slot 3. The keno-game playing apparatus further includes a coin payoff return port 6 for paying off coins to the player when the player wins each game. A payoff coin counter 7 is arranged near the coin payoff return port 6 to count coins to be paid off. As shown in FIG. 2, the inserted coin counter 8, the payoff coin counter 7, the start button 4, the cancel button 5, the light pen 2, and a CRT display 1*a* are connected to a central processing unit 10 arranged inside the keno-game playing apparatus. The central processing unit 10 is connected to a random number generator 11 for generating random numbers, a screen controller 12 for controlling the CRT screen 1 of the CRT display 1*a*, and a light pen controller 13 for supplying data from the light pen 2 to the central processing unit 10.

A block a consisting of rectangular areas A1 to A80 totaling 80 numerals and a block B consisting of 20 rectangular areas B1 to B20 are displayed on the CRT screen 1, as shown in FIG. 3. The rectangular areas B1 to B20 of the block B are grouped in units of five areas, so that the number of rectangular areas can be easily counted. The block B is always displayed during a game and even when the machine is in a standby state. FIG. 3A shows an individual block of the number matrix of block A.

Figure 6:
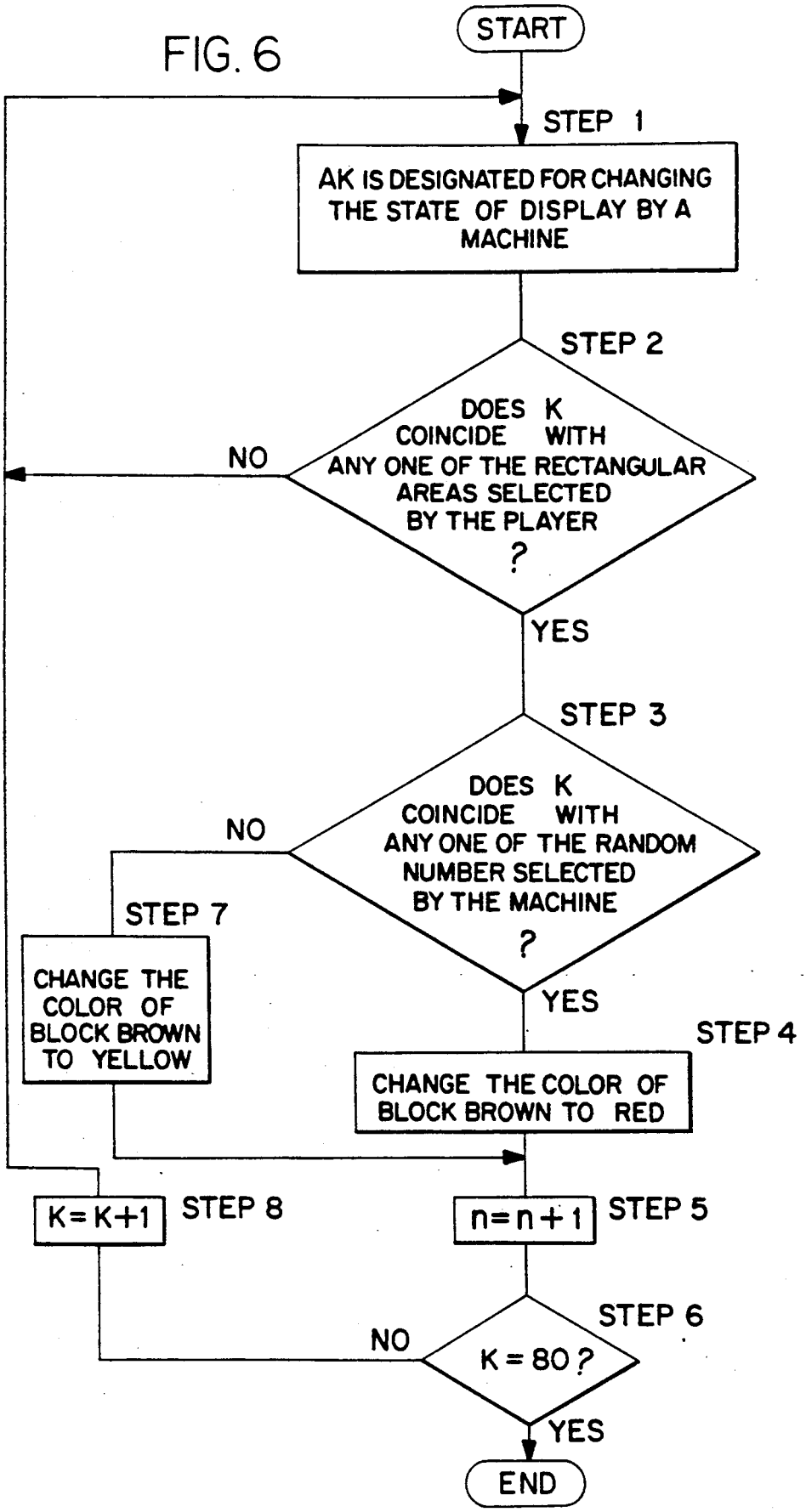
FIG. 6 is a flow chart illustrating operation of the disclosed keno-game playing apparatus.

Operation of the keno-game playing apparatus having the arrangement described above will be described below and with reference to FIG. 6.

A player of the keno-game playing apparatus inserts a predetermined number of coins in the coin slot 3. The player then selects two to 10 rectangular areas with desired numerals from the block A displayed on the CRT screen by pressing the tip of the light pen against the designated rectangular areas (Step 1). These designated numerals are input and stored in the central processing unit 10 through the light pen controller 13. A check mark is displayed in place of the numeral in the rectangular area designated with the light pen 2. Screen control and data input control are known to those skilled in the art, and a detailed description thereof will be omitted.

Figures 4A, 4B, 4C:
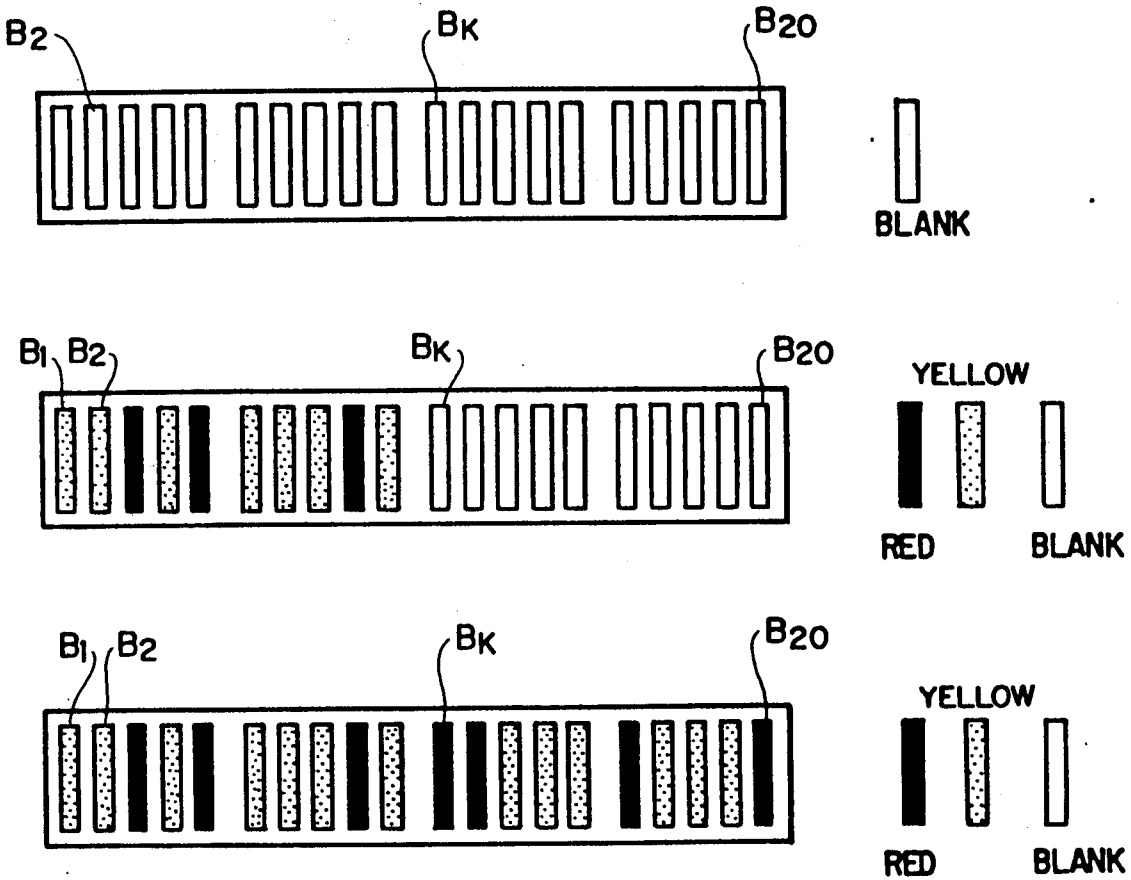
FIGS. 4A, 4B, and 4C are views showing a display state of block B of FIG. 3 as one of the display units shown in FIG. 1.

After designation of the desired numerals, the player depresses the start button 4 of the keno-game playing apparatus. The rectangular areas of the block B are displayed as blank rectangular areas on the CRT screen 1 in accordance with a signal from the start button 4, as shown in FIG. 4A. The central processing unit 10 causes the system to play music in response to a signal from the start button 4. When a predetermined period of time elapses upon depression of the start button 4, the random number generator 11 connected to the central processing unit 10 generates 20 random numbers. The display colors of rectangular areas Ak (k=1 . . . 80) corresponding to the numerals designated by the random numbers are sequentially changed at predetermined time intervals. When some numerals designated by the random numbers coincide with some numerals selected by the player, the player hits the numerals (Step 2 and 3) selected by the random numbers. The background of each hit rectangular area is changed in color from blue to yellow (Step 7) and the corresponding numeral is changed in color from yellow to red. If a miss occurs, the background is changed in color from blue to red, but the corresponding numeral is not changed in color (Step 4). Twenty numerals are designated in correspondence with the random numbers generated by the random number generator 11. When the display colors of the rectangular areas corresponding to the designated numerals within the block A are all changed to yellow or red, the keno-game ends This process is repeated number by number until all number in the matrix A have been compared with the inputted numbers.

Figure 5A:
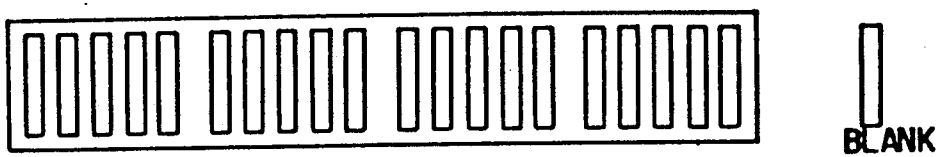
FIGS. 5A, 5B, and 5C are view showing another display state of the block B of FIG. 3 as one of the display units (FIG. 3) in association with the progress of the game.
Figure 5B:
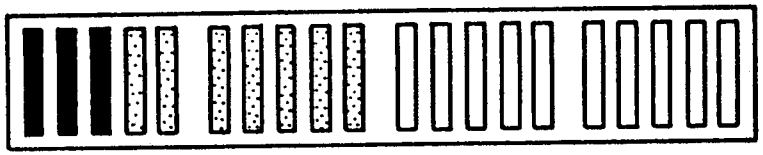
Figure 5C:
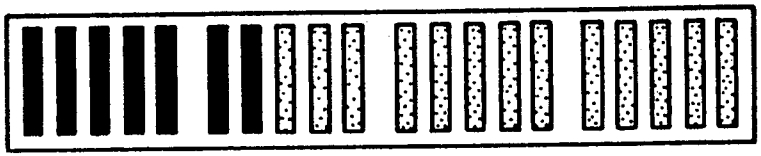

During the game, every time a numeral is designated by a random number in the playing apparatus, i.e., every time the color of a rectangular area is changed, rectangular areas 1–20 of the block B on the CRT screen 1 are sequentially changed in color to red. When a hit occurs, i.e., a numeral designated by the player coincides with a numeral designated by any random number in the keno-game playing apparatus, the corresponding rectangular area Bk (k=1 . . . 20) is changed in color not to red but to yellow. When each game is ended, all the rectangular areas B1 to B20 in the block B in FIG. 4C are changed in color to red or yellow. In this manner, during the keno-game, the player can know the progress of the game and the number of hits by observing the display of block B on the CRT screen 1. A method of displaying the block B is not limited to the one shown in FIGS. 4A, 4B, and 4C. For example, as shown in FIGS. 5A, 5B, and 5C, each time the keno-game playing apparatus selects a numeral, the rectangular areas of the block B may be sequentially changed in color to blue from the left side thereof. If a hit occurs, the rectangular areas of the block B may be changed in color to red from the right side thereof. The player can easily know the number of hits.

When the keno-game concludes, the number of payoff coins is calculated by a rate table (not shown) arranged in the central processing unit 10 using the number of coins inserted in the apparatus and the number of hits, and the number of payoff coins is displayed on the CRT screen 1. The coin payoff information is transmitted to the coin payoff counter, and the coins are paid off from the coin payoff return port 6.

The block B is displayed on the CRT screen 1 only when the start button 4 is depressed.

In this embodiment, the rectangular areas in block A are always ON prior to the start of the game. However, each rectangular area in the block A may randomly flash to attract the attention of potential players. In this case, flashing of each rectangular area in block A on the CRT screen 1 is stopped upon insertion of a coin in the apparatus, so that the player can easily designate the desired rectangular areas.

In the above embodiment, upon depression of the start button, the rectangular areas of the block A on the CRT screen 1 may randomly flash in various colors Alternatively, during the game, the rectangular areas 1–20 of block A except for the rectangular areas corresponding to numerals designated by the random numbers and the rectangular areas corresponding the numerals designated by the player may continuously flash.

From the invention thus described, it will be obvious that the invention may be varied in many ways. Such variations are not to be regarded as a departure from the spirit and scope of the invention, and all such modifications as would be obvious to one skilled in the art are intended to be included within the scope of the following claims.

I claim:

1. A Keno game playing apparatus comprising:

first display means for displaying a plurality of natural numbers;

designating means for designating a plurality of designated numbers chosen by a player from the plurality of natural numbers displayed on said first display means;

random number generating means for randomly generating a subset of numbers comprising a plurality of randomly generated numbers from the plurality of natural numbers displayed on said first display means;

selection display means, responsive to said random number generating means, for sequentially displaying the plurality of randomly generated numbers from the plurality of natural numbers displayed on said first display means;

judging means for judging whether which, if any, of said plurality of designated numbers coincide with the subset of randomly generated numbers; and second display means having a plurality of blocks arranged in a single line, each of said blocks being sequentially changed to a first color whenever a random number from said subset of numbers coincides with a designated number from said plurality of designated numbers and to a second color whenever a designated number from said plurality of designated numbers does not coincide with a random number from said subset of numbers; said first color being indicative of a player hit; said second color being indicative of a player miss; whereby, the player can visually determine the relative number of hits from misses by looking at the color of each block in the second display means as each random number from the subset of natural numbers is generated.

2. A Keno game playing apparatus according to claim 1, wherein said plurality of blocks is comprised of twenty blocks, separated into groups of five blocks.

* * * * *